US010035344B2

(12) United States Patent
Koizumi et al.

(10) Patent No.: US 10,035,344 B2
(45) Date of Patent: Jul. 31, 2018

(54) PRINTING APPARATUS AND PRINTING METHOD

(71) Applicant: CANON KABUSHIKI KAISHA, Tokyo (JP)

(72) Inventors: Kazuya Koizumi, Tama (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/492,360

(22) Filed: Apr. 20, 2017

(65) Prior Publication Data

US 2017/0341383 A1 Nov. 30, 2017

(30) Foreign Application Priority Data

May 30, 2016 (JP) ..... 2016-107790

(51) Int. Cl.
*B41J 2/045* (2006.01)
*B41J 3/54* (2006.01)

(52) U.S. Cl.
CPC ..... *B41J 2/04573* (2013.01); *B41J 2/0458* (2013.01); *B41J 2/04553* (2013.01); *B41J 2/04581* (2013.01); *B41J 2/04586* (2013.01); *B41J 3/543* (2013.01)

(58) Field of Classification Search
CPC .. B41J 2/04573; B41J 2/04586; B41J 2/2135; B41J 2/2132; B41J 2/04553; B41J 2/0458; B41J 2/04581; B41J 3/543
See application file for complete search history.

(56) References Cited

U.S. PATENT DOCUMENTS 9,545,788 B1 * 1/2017 Shikama ..... B41J 2/04508
2015/0343766 A1 * 12/2015 Noda ..... B41J 2/04573 347/14

FOREIGN PATENT DOCUMENTS

JP 2009-234192 A 10/2009

* cited by examiner

*Primary Examiner* — Thinh H Nguyen

(74) *Attorney, Agent, or Firm* — Fitzpatrick, Cella, Harper & Scinto

(57) ABSTRACT

In a printing apparatus, an indefinite area in which slits are not formed is configured in a portion of a linear encoder scale in a rotation direction, and an adjustment unit adjusts the timing of discharge from a printhead with respect to a first printing area out of a plurality of printing areas on a rotating member, without using a detection result of a first encoder sensor, based on a detection result of a second encoder sensor, the first encoder sensor being provided at a position corresponding to the indefinite area during a discharge of printing material with respect to the first printing, and the second encoder sensor being provided at a position that does not correspond to the indefinite area during the discharge of the printing material with respect to the first printing area.

18 Claims, 18 Drawing Sheets

IMAGE FORMATION AREA WIDTH : W(deg)
HEAD WIDTH : H(deg)
ENCODER SCALE AREA (360 DEGREE − JOINT PORTION) : S(deg)
DISTANCE BETWEEN ENCODER SCALE START (JOINT ENDPOINT) AND IMAGE FORMATION START : D(deg)

COMPOSITION CONDITION
$W + H < S - D$

W + H IS SCALE LENGTH REQUIRED FROM MOST UPSTREAM HEAD START TO MOST DOWNSTREAM HEAD END

IMAGE FORMATION AREA WIDTH : W(deg)
HEAD NOZZLE WIDTH : N(deg)
ENCODER SCALE AREA (360 DEGREE – JOINT PORTION) : S(deg)
DISTANCE BETWEEN ENCODER SCALE START (JOINT ENDPOINT)
AND IMAGE FORMATION START : D(deg)

COMPOSITION CONDITION
$W + H < S - D$

W + H IS SCALE LENGTH REQUIRED FROM MOST UPSTREAM HEAD
START TO MOST DOWNSTREAM HEAD END

PRINTING APPARATUS AND PRINTING METHOD

BACKGROUND OF THE INVENTION

Field of the Invention

The present invention relates to a printing apparatus and a printing method.

Description of the Related Art

In an inkjet printing apparatus, a configuration in which is provided, as a means for optimizing printing speed, one or a plurality of printheads (lineheads) in which nozzles are arranged along a width of the printing medium or more is known. An inkjet printing apparatus provided with a linehead (hereinafter, a linehead printing apparatus) forms an image on a printing medium by discharging ink from a linehead while feeding the printing medium at a fixed speed in a direction approximately perpendicular to a widthwise direction. To perform high-quality image generation in such a linehead printing apparatus, it is necessary to cause ink droplets to land on the printing medium with high precision.

In addition, there are printing apparatuses that use an intermediate transfer body to form an image on a printing medium, and a belt, a rotating member such as a drum, or the like is used as the intermediate transfer body.

In an inkjet printing apparatus that supports a plurality of colors, there is a need to arrange lineheads of a plurality of colors in order in a rotation direction of a rotating member (intermediate transfer body). In addition, to keep the angle of a linehead in a vertical state, the diameter of the rotating member needs to be large. Accordingly, along with the diameter of the rotating member being large, a plurality of print faces are provided on a surface of the rotating member. Meanwhile, to discharge at high precision on the rotating member, a need to install a linear encoder scale at a position close to a circumference of the rotating member and perform discharge control arises. Regarding an edge of the linear encoder scale, considering that a rotating member itself undergoes thermal expansion, a fixed length cannot be configured, and a connection is necessary. In such a case, there is a problem in that, if there is a head performing printing (discharging) when the connection passes the detection sensor, it becomes impossible to discharge at a normal discharge spacing, and image unevenness occurs.

Japanese Patent Laid-Open No. 2009-234192 recites a configuration that detects a connection of an intermediate transfer body, and uses two sensors changing between them. In such a case, because there is one change point, a change of the sensors occurs part way through a print face, and an influence of a phase difference due to, for example, attachment between the two sensors is received. As a result, for example print trigger spacing that is extremely short occurs, and image unevenness occurs. In addition, in a case of printing to the same print face by printheads of a plurality of colors, if print triggers generated in accordance with sensors that differ in accordance with the color are used, because a phase relationship between two sensors changes during printing due to thermal expansion or the like, error factors relating to alignment between colors increase. As a result, there is a problem of an effect of misalignment between colors. Accordingly, there is a demand to have one encoder sensor used, in a case of printing by printheads of a plurality of colors to the same print face, when performing image forming for each color to the same print face.

SUMMARY OF THE INVENTION

According to one aspect of the present invention, there is provided a printing apparatus, comprising: a rotating member having a plurality of printing areas on a circumference thereof; a printhead configured to discharge printing material onto the plurality of printing areas; a linear encoder scale having slits and provided on the rotating member along a rotation direction; a plurality of encoder sensors provided at different positions in the rotation direction of the linear encoder scale, and configured to detect the slits of the linear encoder scale; and an adjustment unit configured to adjust a timing of discharge from the printhead by using a detection result by the plurality of encoder sensors, wherein an indefinite area in which the slits are not formed is configured in a portion of the linear encoder scale in the rotation direction, and the adjustment unit adjusts the timing of discharge from the printhead with respect to a first printing area out of the plurality of printing areas, without using a detection result of a first encoder sensor, based on a detection result of a second encoder sensor, the first encoder sensor being provided at a position corresponding to the indefinite area during a discharge of printing material with respect to the first printing, and the second encoder sensor being provided at a position that does not correspond to the indefinite area during the discharge of the printing material with respect to the first printing area.

According to another aspect of the present invention, there is provided a printing apparatus, comprising: a rotating member having a plurality of printing areas on a circumference thereof; a printhead configured to discharge printing material onto the plurality of printing areas; a linear encoder scale having slits and provided on the rotating member along a rotation direction; a plurality of encoder sensors provided at different positions in the rotation direction of the linear encoder scale, and configured to detect the slits of the linear encoder scale; and an adjustment unit configured to adjust a timing of discharge from the printhead by using a detection result by the plurality of encoder sensors, wherein the linear encoder scale is provided on the rotating member so that there is a space in a portion of the linear encoder scale in the rotation direction, the adjustment unit adjusts the timing of discharge from the printhead with respect to a first printing area out of the plurality of printing areas, without using a detection result of a first encoder sensor, based on a detection result of a second encoder sensor, the first encoder sensor being provided at a position corresponding to the space during a discharge of printing material with respect to the first printing, and the second encoder sensor being provided at a position that does not correspond to the space during discharge of the printing material with respect to the first printing area.

According to another aspect of the present invention, there is provided a printing method in a printing apparatus, the printing apparatus having a rotating member having a plurality of printing areas on a circumference thereof, a printhead configured to discharge printing material on the plurality of printing areas, a linear encoder scale having slits and provided on the rotating member along a rotation direction, and a plurality of encoder sensors provided at different positions in the rotation direction of the linear encoder scale, and configured to detect the slits of the linear encoder scale, an indefinite area in which the slits are not formed being configured in a portion of the linear encoder scale in the rotation direction, the printing method comprising: adjusting a timing of discharge from the printhead by using a detection result by the plurality of encoder sensors, wherein, the timing of discharge from the printhead is adjusted with respect to a first printing area out of the plurality of printing areas, without using a detection result of a first encoder sensor, based on a detection result of a second encoder sensor, the first encoder sensor being provided at a position corresponding to the indefinite area during a discharge of printing material with respect to the first printing, and the second encoder sensor being provided at a position that does not correspond to the indefinite area during discharge of the printing material with respect to the first printing area.

By virtue of the present invention, it is possible to suppress influence on a print image caused by a connection for a linear encoder scale.

Further features of the present invention will become apparent from the following description of exemplary embodiments (with reference to the attached drawings).

DESCRIPTION OF THE EMBODIMENTS

Explanation is given below in detail, with reference to the drawings, of embodiments of the present invention as an example. However, a relative arrangement of configuration elements, display screens, an order of processing or the like recited in the embodiments are not particularly intended to limit the scope of the invention thereto, unless specifically stated. In addition, although for a printing apparatus explained below, explanation is given for an inkjet printer (hereinafter may be referred to simply as a "printer") as an example, but there is no limitation to this.

[Device Configuration]

Figure 1:
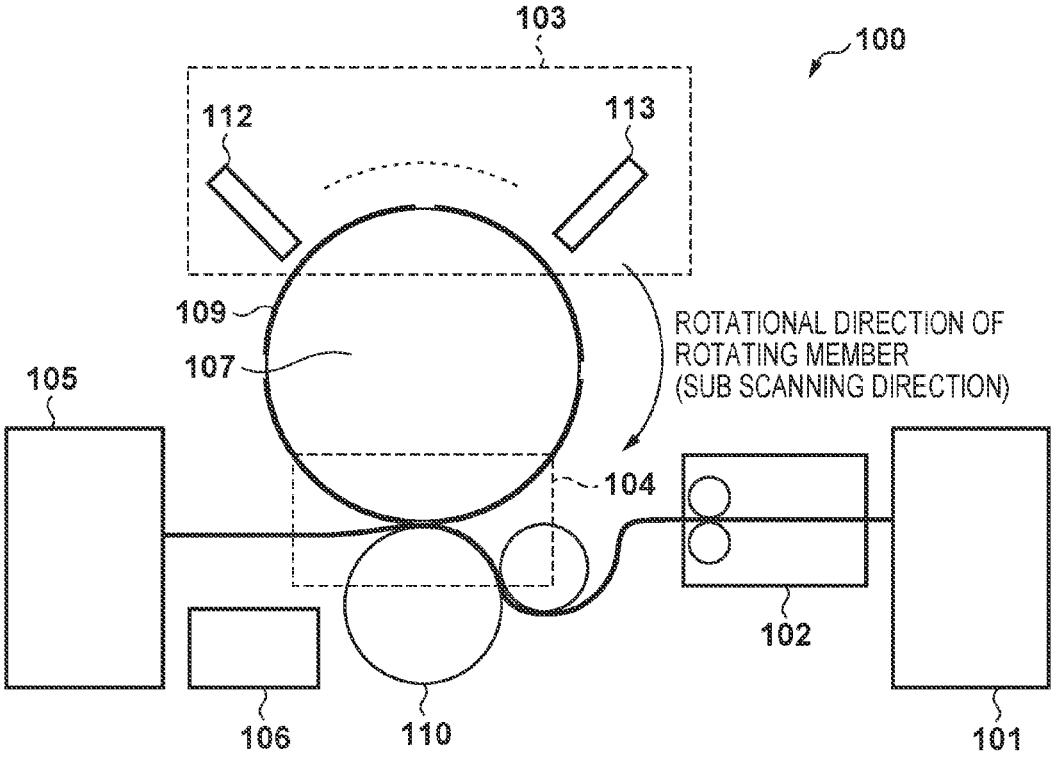
FIG. 1 is a figure explaining an example of an internal configuration of a printing apparatus according to the present invention.

A printer according to the embodiment forms an image on a transfer member installed at a circumference of a rotating member, and furthermore, by transferring the image on the transfer member to a printing medium (hereinafter a printing paper) such as a paper, performs printing to a printing paper. FIG. 1 is a schematic view of a cross section illustrating an example of an internal configuration of a printer 100 according to embodiments. The printer 100 comprises a sheet supply unit 101, an alignment unit 102, a print unit 103, a transfer unit 104, a discharge conveying unit 105, a reversing unit (not shown), and a control unit 106. The printing paper is conveyed by a conveyance mechanism comprising a roller and a belt following a sheet conveyance path indicated by a solid line in FIG. 1, and the processing is performed on each unit.

The sheet supply unit 101 is a unit for housing and supplying one or more types of the printing paper. Configuration may be taken in which the sheet supply unit 101 supplies roll paper by a roller as the printing paper, or configuration may be taken in which the sheet supply unit 101 supplies cut paper from a cassette. The alignment unit 102 is a unit for reducing a tilt of the printing paper supplied from the sheet supply unit 101. By pushing the edge of the printing paper of the side of the reference to a guide portion material, a skew of the printing paper is corrected. Also, when the printing paper is supplied to the alignment unit 102 and print preparation is completed, it outputs a leading edge detection signal of the paper and notifies timing for printing to the control unit 106.

The print unit 103 has a plurality of printheads for a rotating member 107. In FIG. 1, a printhead is installed above the circumference of the rotating member 107, a printhead 112 indicates the most upstream head of a plurality of printheads, and a printhead 113 indicates the most downstream head of the plurality of printheads. In the explanation below, the printhead 112 is referred to as the most upstream head, and the printhead 113 is referred to as the most downstream head. It is assumed that upstream/downstream here is with respect to the rotation direction of the rotating member 107. Only printheads 112 and 113 are illustrated in FIG. 1, but it is assumed that a plurality of printheads are also installed between these. Also, the plurality of printheads are arranged in parallel along the rotation direction of the rotating member 107. The printheads are units for forming an image on a transfer member 109. In the present embodiment, the size of the rotating member 107 is determined so that printing areas for 4 images are provided on the rotating member 107 as the transfer member 109. Also, in FIG. 1, it is assumed that the rotating member 107 rotates in a clockwise direction, and this rotation direction is a sub scanning direction. In other words, by the rotating member 107 rotating, images are formed sequentially from the printhead 112 which is the most upstream head until the printhead 113 which is the most downstream head on the transfer member 109 which is provided on the circumference of the rotating member 107.

Each printhead comprises a line type printhead in which an ink-jet nozzle array is formed within a range covering a maximum width of a printing paper envisioned to be used. The printhead comprises one or more nozzle arrays. For the ink-jet method there is no particular limitation, and it is possible to employ a method using an electric to thermal conversion device as a printing element, a method using a piezoelectric element, a method using an electrostatic element, a method using a MEMS element, or the like. The ink (the printing material) of each color discharged by the printhead is supplied from an ink tank (not shown) to the printhead.

The transfer unit 104 is a unit for performing image formation on printing paper by transferring the image formed on the transfer member 109 by the print unit 103 to the printing paper fed from the sheet supply unit 101. The transfer unit 104 causes the image to be transferred to the printing paper by adding heat and pressure between the rotating member 107 and an image conveyance drum 110. Also, the transfer unit 104 simultaneously causes the image to be fixed to the printing paper. The discharge conveying unit 105 comprises a conveyance mechanism for conveying the printing paper on which the image is formed in the transfer unit 104, and one or more conveyance trays (not shown) to store the printing paper to be already printed by the conveyance function. The control unit 106 controls the whole of the printer 100. Details of an example of a configuration of the control unit 106 will be explained later using FIG. 4.

(Print Unit)

Figure 2A:
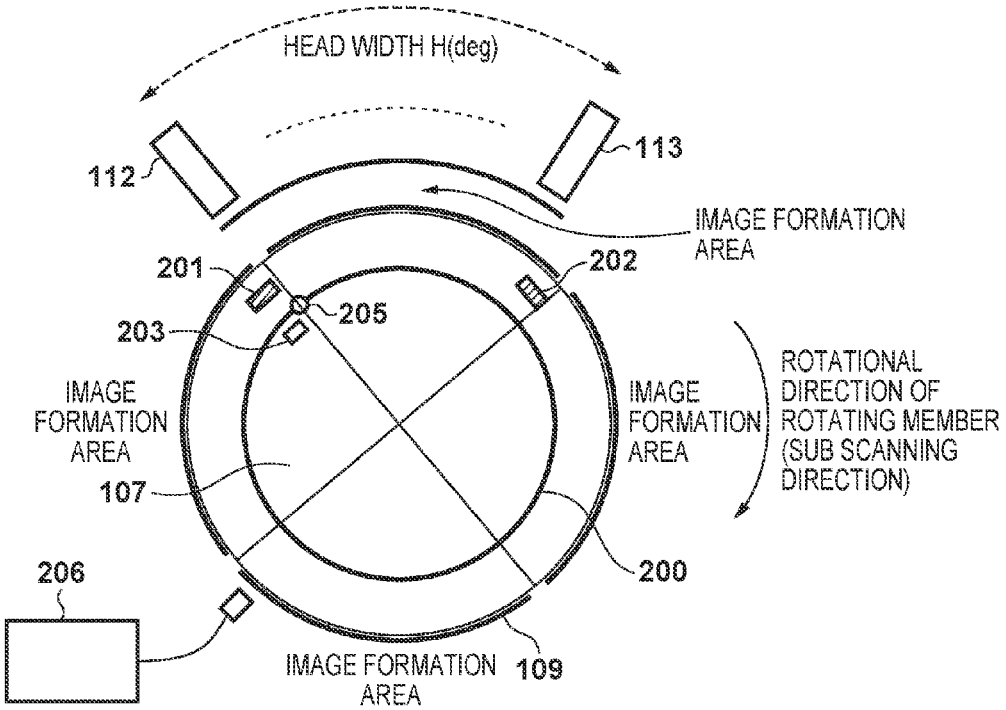
FIGS. 2A and 2B are figures for explaining a print unit according to the present invention.
Figure 2B:
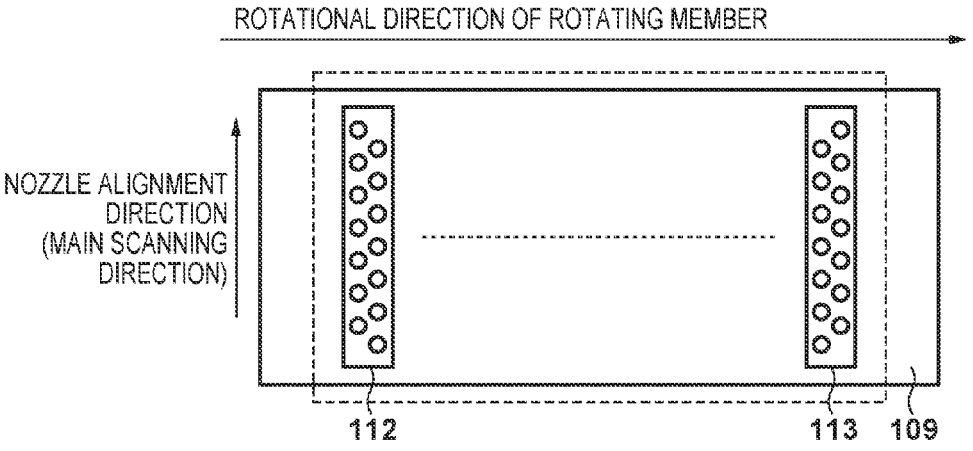

FIG. 2A and FIG. 2B are figures for explaining the print unit 103 that performs printing on the printing paper. FIG. 2A is a figure for viewing the print unit 103 with respect to a main scanning direction (a nozzle alignment direction of the printhead), and FIG. 2B is a figure for viewing the print unit 103 from the side of the printhead. In FIG. 2B, portions illustrated in the printhead signify nozzles (printing elements). A plurality of printheads are arranged in parallel so as to line up in the rotation direction of the rotating member 107. A driving source (not shown) is provided on the center axis of the rotating member 107 (directly or indirectly), and by this driving the transfer member 109 which is arranged on the circumference of the rotating member 107 is conveyed in the direction of the arrow symbol (clockwise in FIG. 2A, rightward in FIG. 2B). On the circumference of the rotating member 107, a plurality of image formation areas (a plurality of print faces) are configured. A linear encoder scale 200 is arranged on the rotating member 107, specifically on the circumference of the rotating member 107 or a position near to the circumference. Also, an encoder sensor 201 which detects the linear encoder scale 200 is arranged upstream in the rotation direction from the discharging position of the ink of the printhead 112. Also, an encoder sensor 202 which detects the linear encoder scale 200 is arranged downstream in the rotation direction from the discharging position of the ink of the printhead 113. The linear encoder scale 200 comprises one connecting portion 205 at the position of a non-printing area (between one printing area and another printing area). Also, on the linear encoder scale 200 there are slits (patterns) at predetermined spacings. The connecting portion 205 is a portion where there is a space in the linear encoder scale 200 for thermal expansion or the like, and as a matter of course, there is no slit therein. Therefore, if the connecting portion 205 is read by encoder sensors 201 and 202, a read value will be indefinite. Here, the connecting portion 205 is also referred to as an indefinite area. Note that, the width of the connecting portion 205 in the rotation direction of the rotating member 107 is not particularly limited because it varies depending on the size of the rotating member 107 or other configuration conditions. A rotation phase of the rotating member 107 is detected by the encoder sensors 201 and 202. The encoder sensors 201 and 202 are installed outside of an angle corresponding to a head width H (deg) (the dashed line arrow symbol in FIG. 2A) in the rotation direction of the rotating member 107. However, there is no necessity for them to be outside if a later-described configuration condition of the present invention is satisfied. An encoder reference position sensor 203 for detecting the origin point of the rotating member 107 is installed in the rotating member 107. An environmental temperature detection sensor and an environmental humidity detection sensor (not shown) may be arranged in the periphery of the print unit 103.

The driving source (not shown) for driving the rotating member 107 executes, by open control, rotation control driving of a motor in accordance with a predetermined speed table. A speed measurement unit 206, for example, measures average speed of the rotating member 107 (the transfer member 109) in a predetermined period (a period for the rotating member 107 to rotate a plurality of times). This average speed is used in control as the conveyance speed of the printing paper. To supplement, the speed measurement unit 206 measures a movement amount (a conveyance amount) of the transfer member 109 in order to measure speed. Accordingly, the control unit 106 generates a discharge timing signal in accordance with the movement amount (the conveyance amount) of the transfer member 109 on the rotating member 107 which can be obtained by signals from the encoder sensors 201 and 202.

A printing element that the printhead comprises is driven based on the printing data (the print data) and the discharge timing signal based on the signals obtained from the encoder sensors 201 and 202. By driving the printing element, ink is discharged from the nozzle and lands on the transfer member 109. Printing of a first color corresponding to the printing data is performed by a first color nozzle of the printhead. Next, printing of a second color corresponding to the printing data is performed by a second color nozzle. By repeating this in the third color nozzle, the fourth color nozzle . . . , the image is formed on the transfer member 109 by the ink. The timing of the print start of each color of the printhead is based on a position detected in the encoder reference position sensor 203, and printing starts at the predetermined position. Because there are 4 image printing areas in one circumference in the present embodiment, the positions of the print start can be provided at 4 points in one circumference for each color. The number of printing areas provided on the rotating member 107 is defined in accordance with the size of the rotating member 107 and the size of printing paper that the printer 100 can support. In addition, the printing area may be defined in accordance with whether the printer 100 supports roll paper or cut paper.

Figure 3:
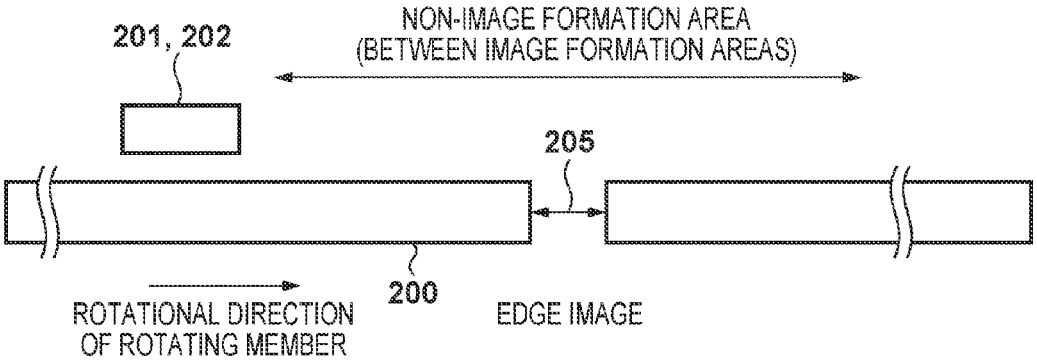
FIG. 3 is a figure explaining an encoder scale installed on a rotating member.

FIG. 3 is a figure for explaining detail about the linear encoder scale 200 installed on the circumference of the rotating member 107 or near the circumference. The connecting portion 205 is produced when the linear encoder scale 200 is installed on the circumference of the rotating member 107. In the present embodiment, configuration is such that the position of the connecting portion 205 is arranged between printing areas. As described above, at the position of the connecting portion 205, the spacing of the linear encoder scale 200 cannot be detected normally. Therefore, the outputs of the encoder sensors 201 and 202 are indefinite, leading to unevenness of an image in a monochrome. Also, because this is a cause of color misalignment between a plurality of colors, it is difficult to satisfy specifications for an ink-jet printer in which high precision printing is required.

(Control Unit)

Figure 4:
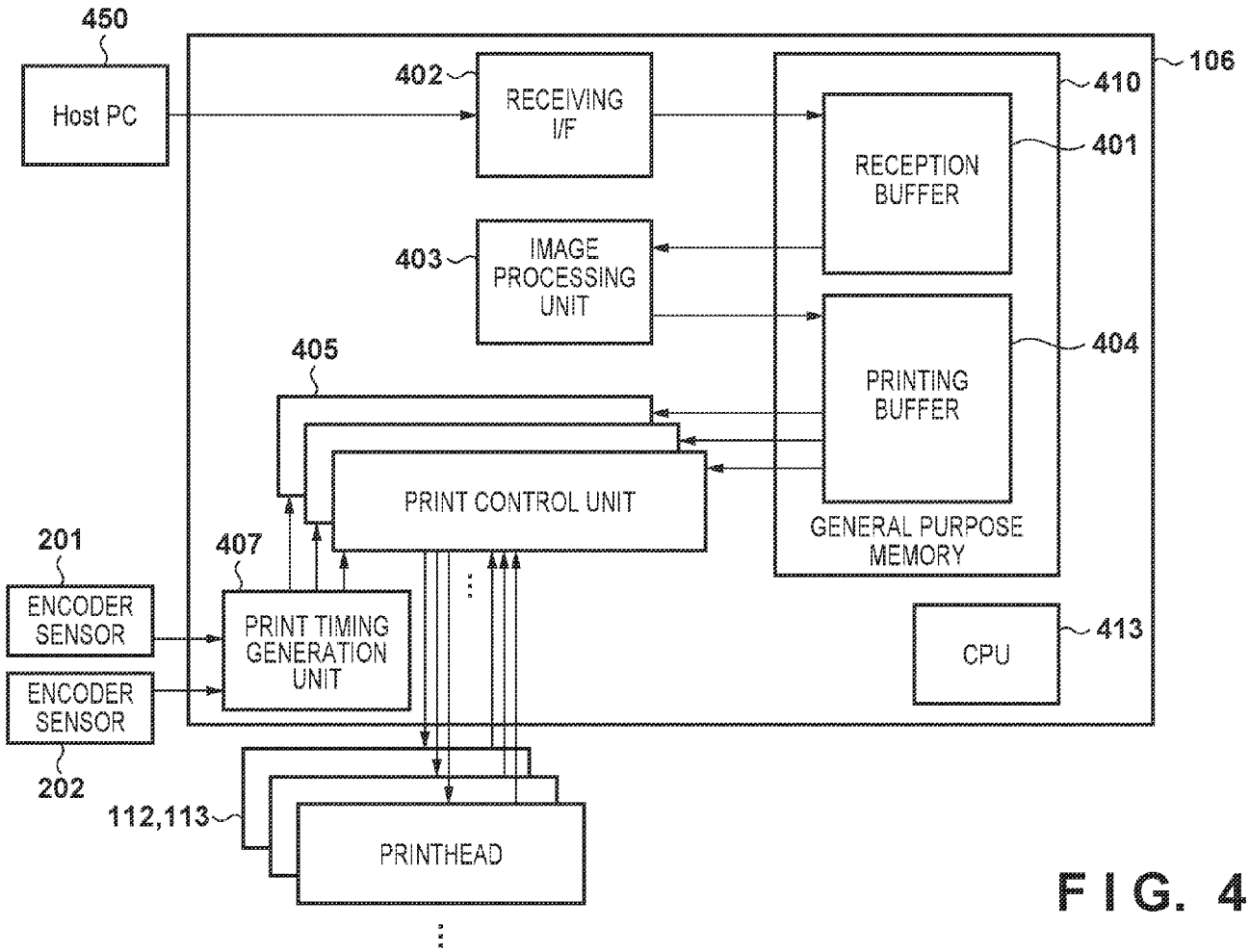
FIG. 4 is a figure explaining a control unit of the printing apparatus according to the present invention.

FIG. 4 illustrates an example of a configuration centering on the control unit 106 of the printer 100 in the present embodiment. With regards to print control, explanation is given in detail using FIG. 5. A reception buffer 401 in the printer 100 main body receives image data, which is to be printed, from a host PC 450 via a receiving I/F 402. An image processing unit 403 reads the image data from the reception buffer 401, and performs processing up to quantization processing. The image processing unit 403 stores the quantized image data to a printing buffer 404. Note that various image processing is performed before the quantizing, but because they are not a feature of the present invention, a conventional method is used, and detailed explanation is omitted.

A print control unit 405 is input with position information from the encoder sensors 201 and 202, and, based on a discharge timing signal generated by a print timing generation unit 407, generates printing data indicating discharge or non-discharge of ink, and transmits printing data to each printhead. Each printhead drives each nozzle based on the sent printing data to discharge ink and print the image on the transfer member 109.

Note that the reception buffer 401 and the printing buffer 404 are portions of a general purpose memory 410 which is a DRAM or the like. However, it does not necessarily need to be a DRAM, and may be a memory (storage apparatus) other than a DRAM, such as an SRAM, if it is a memory that belongs to the scope of the definition of a RAM. In addition, the memory described above may be configured internally, or may be an external general purpose memory. In addition, in the present embodiment explanation is given in which each unit is arranged in one module, but each unit may be made to be an independent module. In addition, a CPU 413 is a central processing unit for controlling the printer 100 overall, and although it is typically connected to each control unit or memory, configuration of connections is omitted here to make the figure easier to understand.

(Print Timing Generation Unit)

Figure 5:
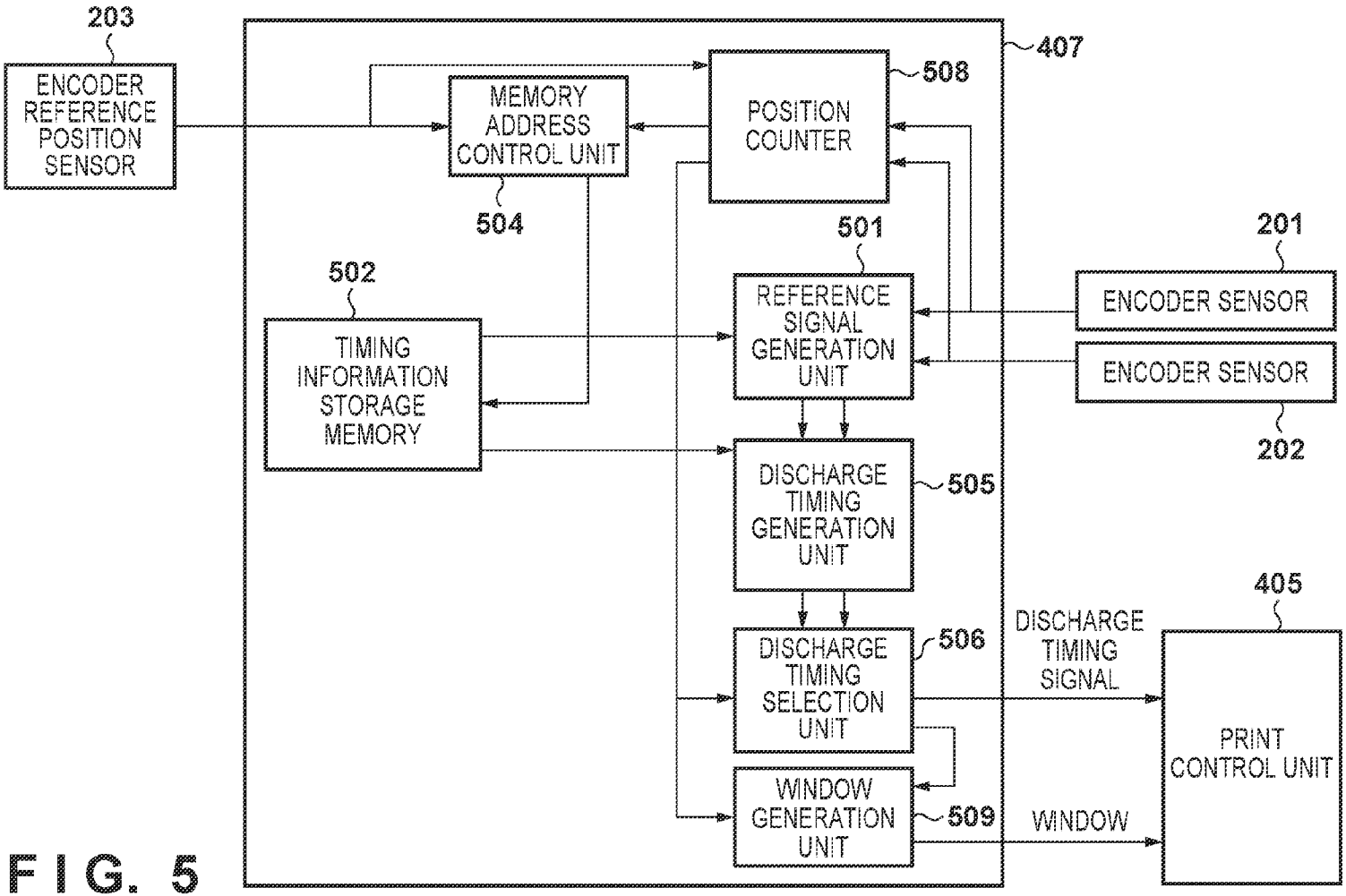
FIG. 5 is a figure explaining detail of a print timing generation unit according to the present invention.

Next, explanation is given for the print timing generation unit 407 which is a feature in the embodiments. FIG. 5 is a view for illustrating an example of a configuration of the print timing generation unit 407 according to the present embodiment. A reference signal generation unit 501 adjusts discharge timing from a plurality of printheads by generating a signal (reference signal) that is a reference for generating a discharge timing, based on position information (detection signal) which is a result of detection by the encoder sensors 201 and 202. The reference signal is a timing signal for indicating an origin for one column of printing. A discharge timing generation unit 505 generates a discharge timing based on information (divisional drive timing, divisional drive spacing, a head information obtainment period) relating to the discharge timing signal during the reference signal generated by the reference signal generation unit 501. The information relating to the discharge timing signal is stored in a timing information storing memory 502, and stored at a position of a memory address in accordance with a position having the encoder reference position sensor 203 (the origin point) as an original point. The position information is notified by a position counter 508. In accordance with address information generated by a memory address control unit 504, the discharge timing generation unit 505 reads information of the discharge timing signal in the timing information storing memory 502, and generates (derives) the discharge timing in accordance with the position. The discharge timing generated by the discharge timing generation unit 505 is selected by a discharge timing selection unit 506, and the discharge timing signal is outputted to the print control unit 405. For a timing at which to change the discharge timing signal used (in other words, the encoder sensor), information of the position counter 508 is used. A detailed explanation of the discharge timing selection unit 506 is described later. In addition, the discharge timing signal selected by the discharge timing selection unit 506 is outputted to a window generation unit 509. The window generation unit 509 generates and outputs to the print control unit 405 a window that indicates a start position of printing and a width of printing based on the position information of the position counter 508.

[Discharge Timing]

Figure 6:
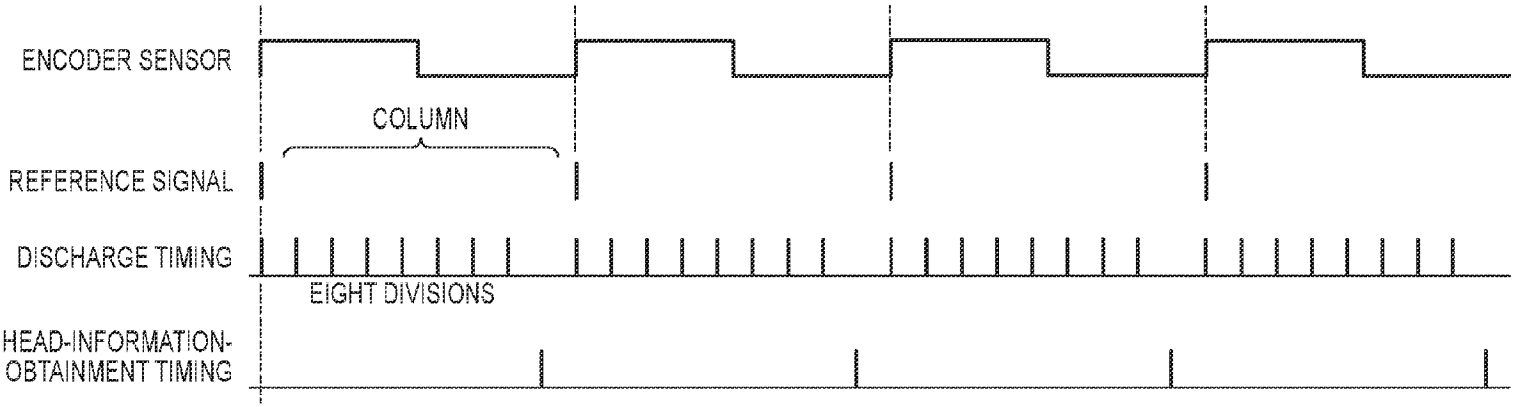
FIG. 6 is a figure illustrating a timing chart for discharge timing generation.

FIG. 6 is a timing chart of discharge timing that is generated by the discharge timing generation unit 505 of FIG. 5. Head-information-obtainment timing indicating the start of head information obtainment (for example, reading of a temperature) and discharge timing divided into eight are generated between reference signals (between 1 column), which is based on a signal from an encoder sensor, based on information in the timing information storing memory 502. Accordingly, one column is configured to include 9 timings. The discharge timings and the head-information-obtainment timings of FIG. 6 are defined with necessary spacing (period) for processing from an origin, and there is a need to capture all processing within a reference signal. Note that explanation is given dividing one column by 8 in FIG. 6, but there is no limitation on the number of divisions in a column. In addition, explanation is given in which one slit of the linear encoder scale is one column in FIG. 6, but there is no limitation to this. For example, a case in which a plurality of slits are used for an encoder signal as one column, or a case in which an encoder signal is divided to make one column can be considered.

Figure 7:
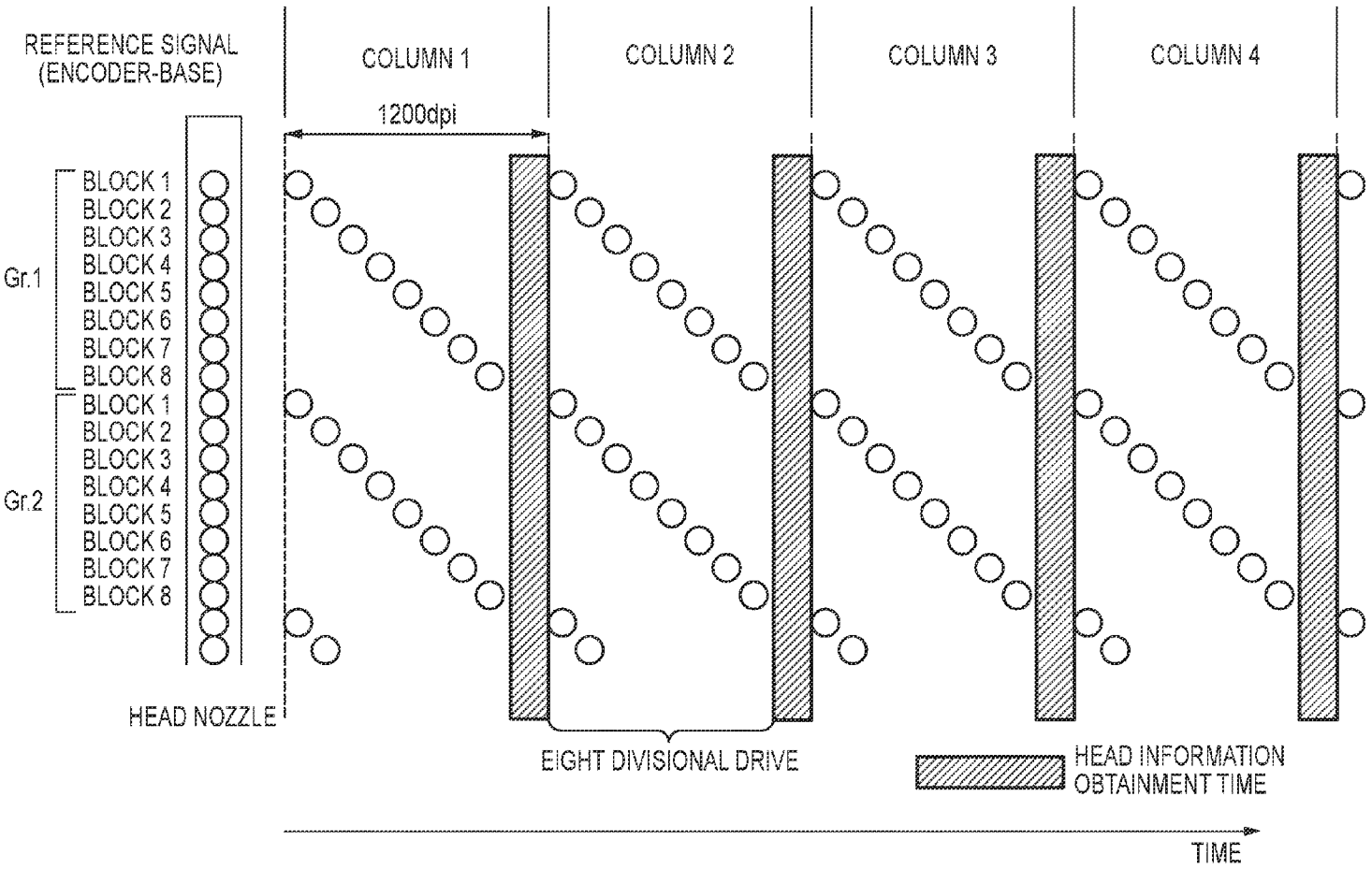
FIG. 7 is a figure for explaining detail of a discharge method when 1 column is subject to 8-division driving.

Next, FIG. 7 is used to explain detail of a discharge method when 1 column is subject to 8-division driving. A block order is allocated for each group (Gr. 1 and Gr. 2 of FIG. 7) as in the head nozzle image of FIG. 7. FIG. 7 illustrates a discharge image when a driving order is block 1→2→3→4→5→6→7→8 in a case of 8-division driving. Blocks having the same number in the groups are controlled so that discharge timings are simultaneous. Discharging onto a paper surface is performed in the block order explained above within the reference signal for one column based on the encoder. A period for obtaining head information (such as the temperature of the printhead) after discharging for 8 blocks is reserved.

Next, explanation is given regarding preconditions for the presence of the connecting portion influencing a print image, and a solution therefor.

Figure 8:
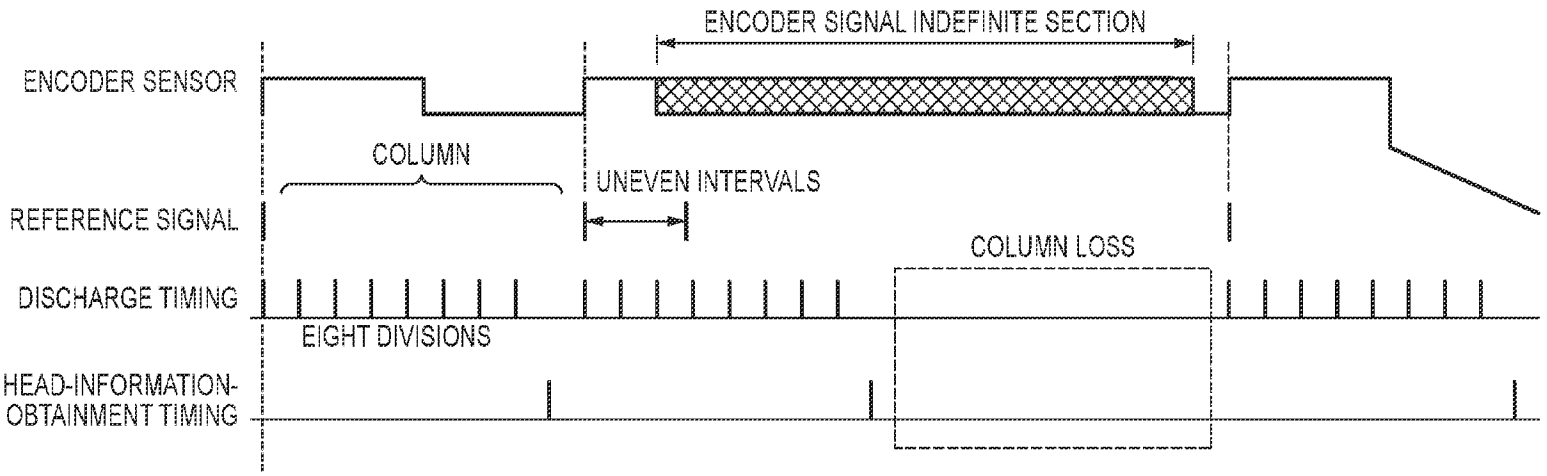
FIG. 8 is a figure illustrating a timing chart for discharge timing generation when passing an indefinite period.

FIG. 8 is a timing chart for the discharge timing generated by the discharge timing generation unit 505 of FIG. 5 when the connecting portion 205 of the encoder explained by FIG. 3 is passed. When passing the connecting portion 205, the encoder sensor cannot appropriately detect the linear encoder scale, and thus the encoder signal becomes an indefinite value. As a result, spacing of the generated reference signal varies. By this, normal discharge timing (8-division driving and the head-information-obtainment timing) within the reference signal becomes impossible, and thereby normal generation of discharge timing becomes impossible. FIG. 8 is for explaining an example in which the next column is missed because the discharge timing signal does not fit within the reference signal. With this, using this discharge timing signal for printing unchanged leads to a harmful effect of misalignment between colors or unevenness of the image.

In addition, changing the print image to avoid the connecting portion 205 may be considered. However, if changing discharge timings part way through is performed within the same print face, influence of a phase difference due to for example of attachment positions between the two sensors is received, for example a spacing of discharge timings that is extremely short occurs, and unevenness of the image occurs.

In addition, even if changing within the same print face is not performed, in a case of printing by printheads of a plurality of colors, if discharge timings that are generated by sensors that differ in accordance with color are used, a phase relationship between the two sensors changes during printing due to thermal expansion or the like. Therefore, error factors relating to alignment between colors will increase. As a result, there is a problem of influencing to cause a misalignment between colors. To solve the problem, there is a necessity to have a configuration for satisfying the precondition of having one encoder sensor used, in a case of printing by printheads of a plurality of colors to the same print face, when performing image forming for each color to the same print face.

Explanation is given below regarding a configuration for satisfying a precondition of having one encoder sensor used when image forming each color (a plurality of printheads) on the same print face, according to embodiments.

Figure 9:
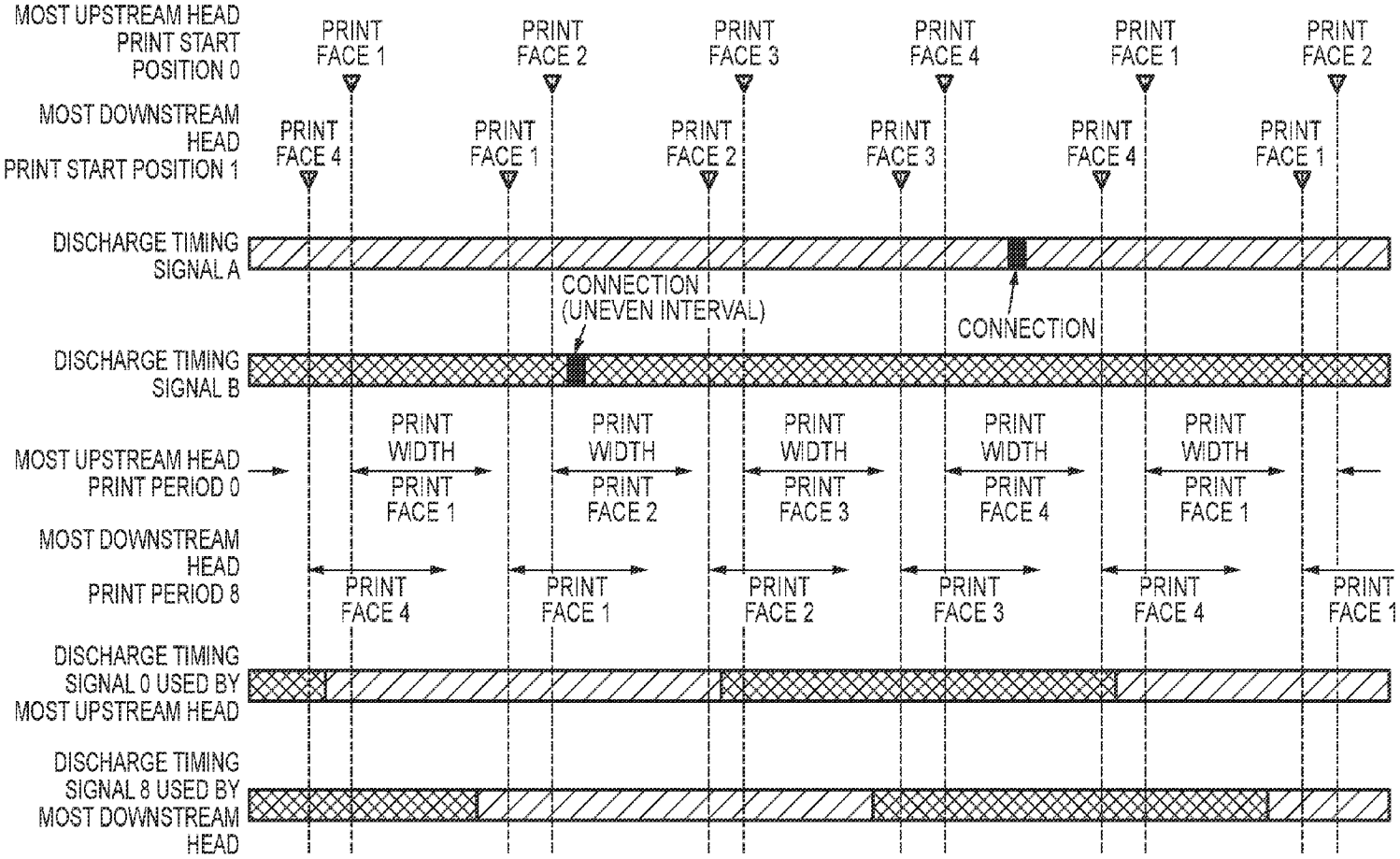
FIG. 9 is a figure illustrating a timing chart for discharge timing generation.

FIG. 9 is a figure for explaining timings for selecting, so that there is no effect on printing, a discharge timing signal generated based on a signal from each encoder sensor by the discharge timing selection unit 506 of FIG. 5, and outputting to a latter-stage print control unit 405. FIG. 9 illustrates relationships for various timings, and illustrates in order from the top:

a print start position 0 (start timing) for the most upstream head (the printhead 112);

a print start position 8 for the most downstream head (the printhead 113);

a discharge timing signal A generated by the encoder sensor 201;

a discharge timing signal B generated by the encoder sensor 202;

a most upstream head printing period 0 indicating a period in which the most upstream head performs printing;

a most downstream head printing period 8 indicating a period in which the most downstream head performs printing;

a discharge timing signal 0 used by the most upstream head; and a discharge timing signal 8 used by the most downstream head.

The discharge timing signal 0 used by the most upstream head indicates a state in which the discharge timing signal A is selected before (in other words, immediately prior to image forming with respect to a first printing area) the position of a print face 1, and the discharge timing signal B is selected before a print face 3. In addition, with the discharge timing signal 8 that the most downstream head uses, the discharge timing signal A is selected before the position of the print face 1, and the discharge timing signal B is selected before the position of the print face 3. The discharge timings of the remaining 7 heads are similarly selected, but are omitted in FIG. 9. In other words, when a plurality of printheads are discharging ink with respect to the same print face, discharge timing signals generated based on signals from the same encoder sensor are used. These selections are performed by the discharge timing selection unit 506.

Referring to FIG. 9, in a case of performing image forming within the same print face, it is understood that changing of the discharge timing signals A and B is not performed. In other words, unevenness of an image due to a phase difference of encoders that is a problem when changing the discharge timing signals A and B within the same print face is eliminated. Specifically, it is possible to eliminate the occurrence of extremely short discharge timings. In addition, in a case of printing on the same print face, discharge timings generated based on signals from the same encoder sensor are used for every printhead. In other words, when a plurality of printheads are discharging ink with respect to the same print face, control is performed such that there is no change to a discharge timing signal generated based on the signal from a different encoder sensor. Therefore, when printing to the same print face by printheads of a plurality of colors, there is no use of discharge timings generated in accordance with signals from different encoder sensors for different colors. In addition, it is possible to perform control without being affected even if the phase relationship between two encoder sensors changes during printing due to thermal expansion or the like during printing, and without increasing error factors relating to alignment between colors.

[Configuration Conditions]

Figure 10:
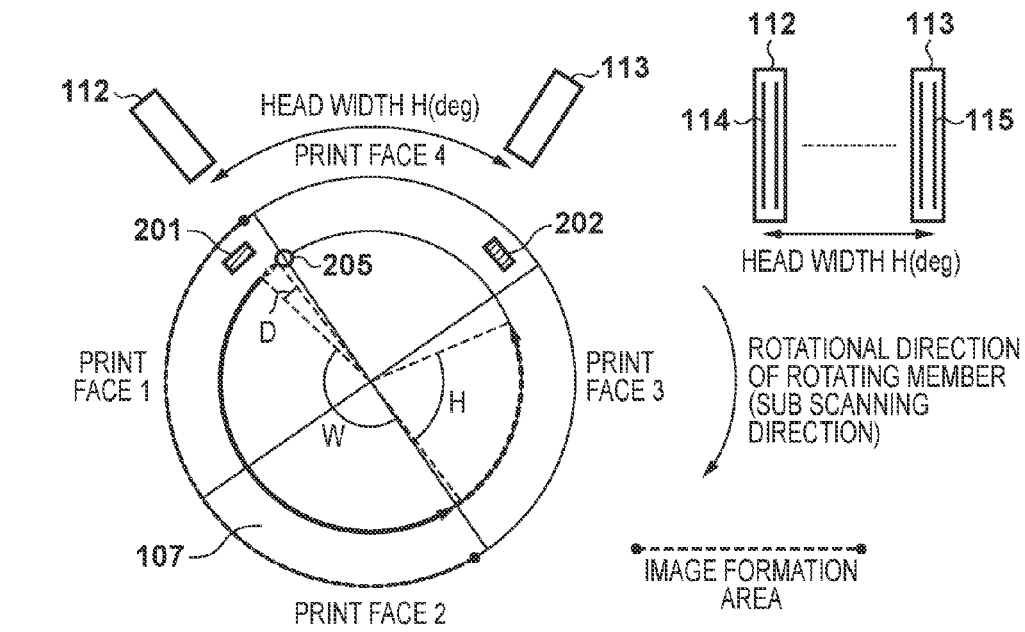
FIG. 10 is a figure for explaining a configuration condition according to the present invention.

FIGS. 10-21 are views for explaining configuration conditions according to embodiments. Note that a rotation direction of the rotating member 107 of FIG. 10 through FIG. 21 is set to clockwise, and this is assumed to be the sub scanning direction. FIG. 10 is a view for illustrating a positional relationship between the rotating member 107, the connecting portion 205, and the encoder sensors 201 and 202, at a timing for the most upstream head (the printhead 112) to start image formation on the print face 1. In addition, it illustrates configuration conditions in a case when the encoder sensor 201 is used to perform image forming on the print faces 1 and 2. A head width H (deg) indicates, by an angle conversion of the rotating member 107, a width from a position of a most upstream nozzle array 114 of the most upstream head (the printhead 112) to a most downstream nozzle array 115 of the most downstream head (the printhead 113). An image formation area width W indicates, by an angle conversion of the rotating member 107, a width of a printing area on which printing is actually performed. This illustrates a case in which the print face 1 and the print face 2 are printed on. A scale area S indicates, by an angle conversion of the rotating member 107, a width of an area, which can be read by the encoder sensors 201 and 202, resulting from subtracting an indefinite portion due to the connecting portion 205 from the entire circumference (360°) of the rotating member 107. D indicates, by an angle conversion of the rotating member 107, a length from the start of the linear encoder scale 200 (an edge of the connecting portion 205) until the start of image forming by the most upstream head (the printhead 112). W+H indicates a scale length necessary for image formation by the most downstream head (the printhead 113) to complete after the most upstream head (the printhead 112) has started image formation. In the present embodiment, the connecting portion 205 must not be included in this area. In the case of FIG. 10, configuration is such that the encoder sensors 201 and 202 are separated and arranged so as to be positioned outside of the head width H for the most upstream head and the most downstream head.

When using the same encoder sensor printheads of all colors to print to the same print face as explained by FIG. 9, satisfying the configuration condition of $$W+H<S-D \quad (1)$$

is necessary. The configuration of FIG. 10 satisfies configuration condition (1).

Figure 11:
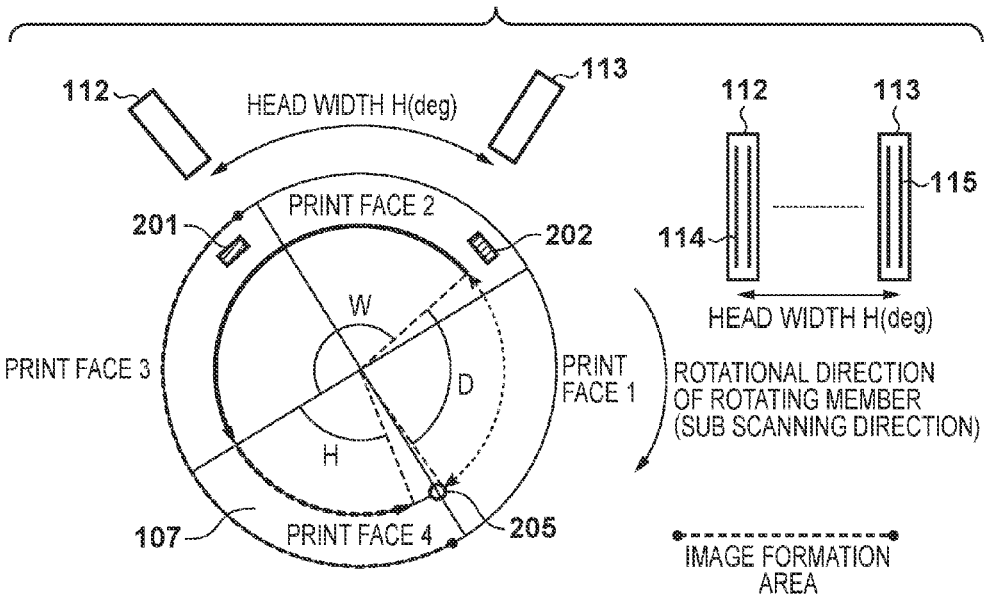
FIG. 11 is a figure for explaining a configuration condition according to the present invention.

FIG. 11 is a view for illustrating a positional relationship between the rotating member 107, the connecting portion 205, and the encoder sensors 201 and 202, at a timing for the most upstream head (the printhead 112) to start image formation on the print face 3. In addition, FIG. 11 illustrates configuration conditions in a case when the encoder sensor 202 is used to perform image forming on the print faces 3 and 4. A head width H (deg) indicates, by an angle conversion of the rotating member 107, a width from a position of the most upstream nozzle array 114 of the most upstream head (the printhead 112) to the most downstream nozzle array 115 of the most downstream head (the printhead 113). An image formation area width W indicates, by an angle conversion of the rotating member 107, a width of a printing area on which printing is actually caused to be performed. This is an example of a case in which the print face 3 and the print face 4 are printed on. A scale area S indicates, by an angle conversion of the rotating member 107, a width of an area, which can be read by the encoder sensors 201 and 202, resulting from subtracting an indefinite portion due to the connecting portion 205 from the entire circumference (360°) of the rotating member 107. D indicates, by an angle conversion of the rotating member 107, a length from the start of the linear encoder scale 200 (an edge of the connecting portion 205) until the start of image forming by the most upstream head (the printhead 112). W+H indicates a scale length necessary for image formation by the most downstream head (the printhead 113) to complete after the most upstream head (the printhead 112) has started image formation. In the present embodiment, the connecting portion 205 must not be included in this area.

In a case where the same encoder sensor is used to print by printheads of all colors to the same print face as explained by FIG. 9, it is necessary to satisfy configuration condition (1). FIG. 11 satisfies configuration condition (1).

In other words, the configuration of the positions of the printheads, the encoder sensors, the linear encoder scale, and the connecting portion have the same conditions in FIG. 10 and FIG. 11, and both satisfy configuration condition (1). Accordingly, they are configurations that enable change control such as using the same encoder sensor to perform printing by printheads of all colors to the same print face as explained by FIG. 9, by taking the configuration of FIG. 10.

Figure 12:
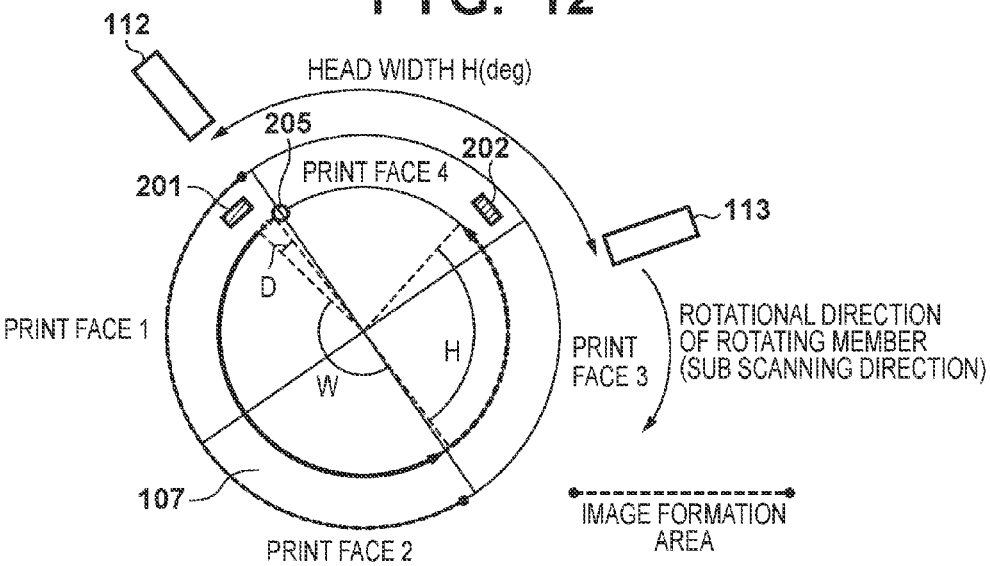
FIG. 12 is a figure for explaining a configuration condition according to the present invention.

FIG. 12 is a view for illustrating a positional relationship between the rotating member 107, the connecting portion 205, and the encoder sensors 201 and 202, at a timing for the most upstream head (the printhead 112) to start image formation on the print face 1. Configuration conditions in a case when the encoder sensor 202 is used to perform image forming on the print faces 1 and 2 are illustrated. This is a configuration in which the head width H (deg) is wider in comparison to that in FIG. 10. In other words, the encoder sensor 202 is positioned between the printheads 112 and 113. In this configuration, it is necessary to satisfy configuration condition (1). The condition of FIG. 12 satisfies configuration condition (1).

Figure 13:
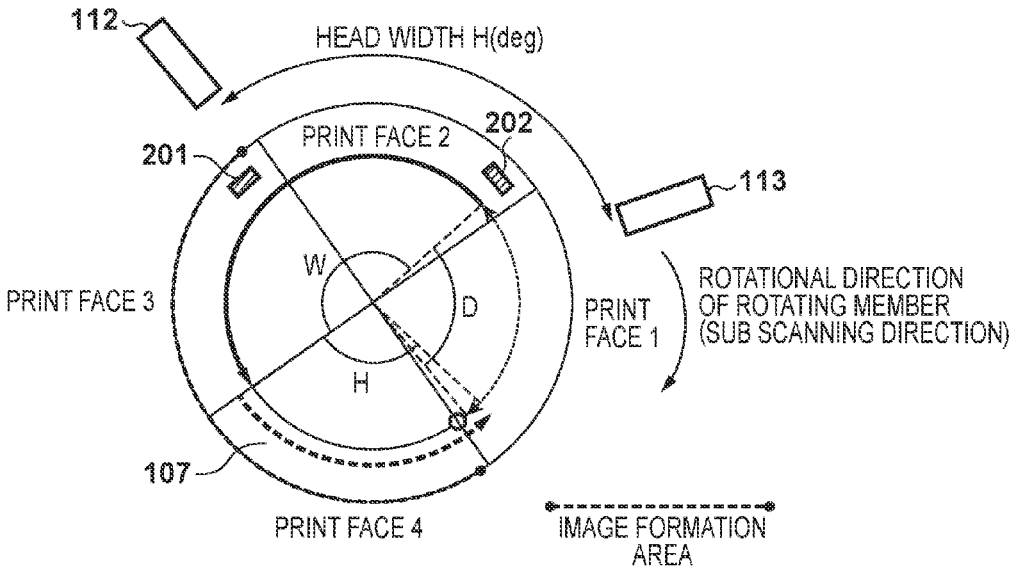
FIG. 13 is a figure for explaining a configuration condition according to the present invention.

FIG. 13 is a view for illustrating a positional relationship between the rotating member 107, the connecting portion 205, and the encoder sensors 201 and 202, at a timing for the most upstream head (the printhead 112) to start image formation on the print face 3. Configuration conditions in a case when the encoder sensor 202 is used to perform image forming on the print faces 3 and 4 are illustrated. This is a configuration in which the head width H (deg) is wider in comparison to that in FIG. 11. In this configuration, it is necessary to satisfy configuration condition (1). However, in FIG. 13, configuration condition (1) is not satisfied. Therefore, performing change control as in FIG. 9 is not possible.

Figure 14:
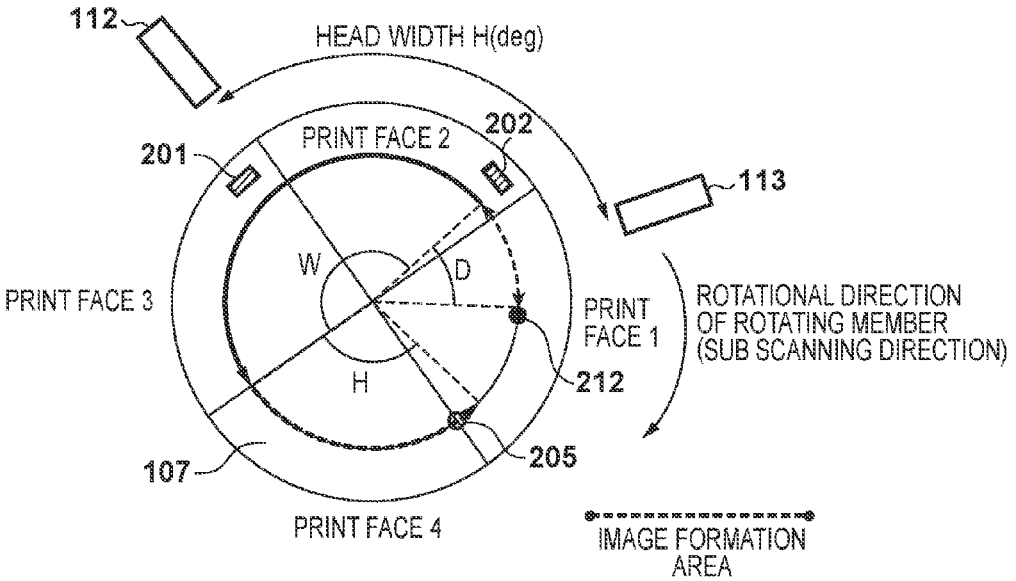
FIG. 14 is a figure for explaining a configuration condition according to the present invention.

FIG. 14 is a configuration in which the position of the connecting portion 205 is moved to a position 212 in comparison to FIG. 13. With this it is possible to satisfy configuration condition (1).

Figure 15:
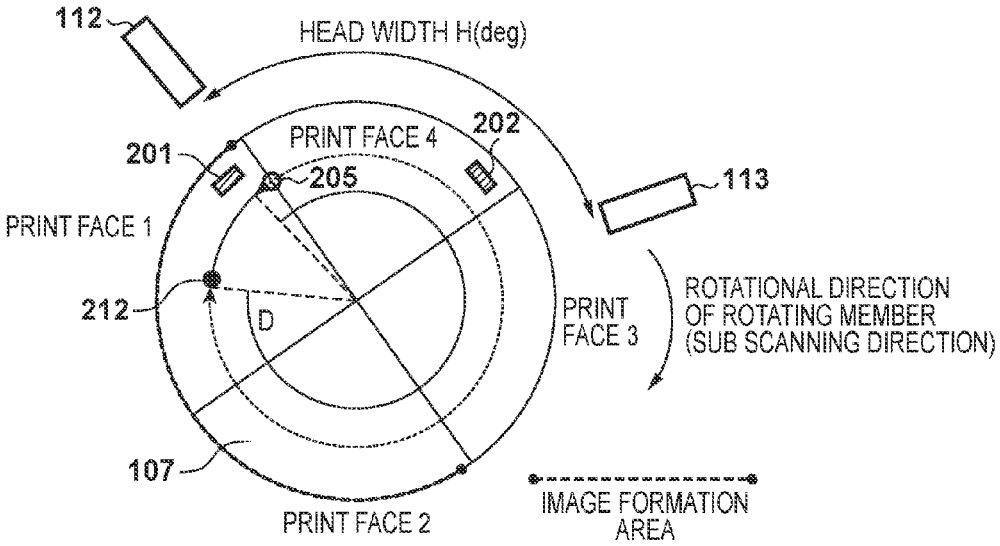
FIG. 15 is a figure for explaining a configuration condition according to the present invention.

FIG. 15 is a configuration in which the position of the connecting portion 205 has moved to the position 212 in comparison to FIG. 12. In other words, this is the same configuration as that of FIG. 14. In such a case configuration condition (1) is not satisfied because the value of D is set to very large.

Figure 16:
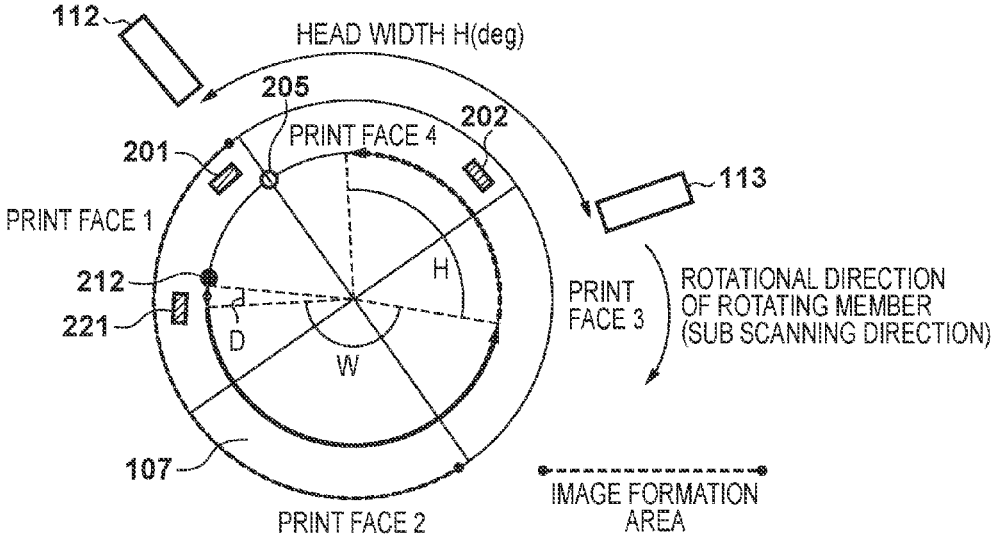
FIG. 16 is a figure for explaining a configuration condition according to the present invention.

FIG. 16 is a configuration in which the position of the encoder sensor 201 is caused to move to the position of reference numeral 221 in comparison to FIG. 15. It is also configuration in which the position of the connecting portion 205 has moved to the position 212 in comparison to FIG. 12. In such a case, configuration condition (1) is satisfied. Accordingly, configuration is such that change control that uses the same encoder sensor for printing by printheads of all colors to the same print face which is explained by FIG. 9 is possible even if the head width H is widened, in accordance with the configuration of FIG. 16.

Figure 17:
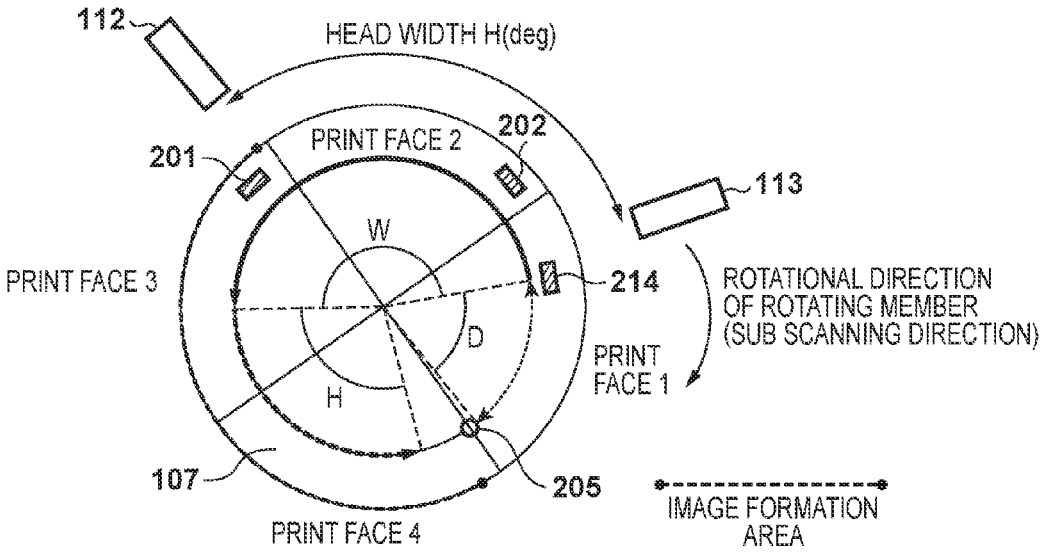
FIG. 17 is a figure for explaining a configuration condition according to the present invention.

FIG. 17 is a configuration in which the position of the encoder sensor 202 is caused to move from the configuration of FIG. 13 to a position 214. In such a case, configuration condition (1) is satisfied. In addition, because only the position of the encoder sensor 202 is changed, the condition explained by in FIG. 12 has not changed. Accordingly, configuration is such that change control that uses the same encoder sensor for printing by printheads of all colors to the same print face which is explained by FIG. 9 is possible even if the head width H is widened, in accordance with the configuration of FIG. 17.

In the present embodiment, by configuring and controlling to satisfy the aforementioned configuration conditions, it is possible to suppress influences on a print image caused by combining the linear encoder scale.

(Different Configurations)

FIG. 10 to FIG. 17 illustrate configuration conditions under a condition that the same encoder sensor is used when printing on the same print face. Configurations different from these configurations are explained by using FIG. 18 through FIG. 21. Here a change within the same print face is not performed for an encoder sensor that one printhead uses; instead a condition configuration is used in which there is a condition such that encoder sensors used by each printhead when printing on the same print face do not need to be the same. In other words, in the example here, when a plurality of printheads are performing image formation with respect to the same print face, there may be a case in which the printheads are each operating in accordance with a discharge timing based on a different encoder sensor. Accordingly, the different configuration indicated here has more relaxed condition than the configuration condition explained by using FIG. 10 to FIG. 17.

Figure 18:
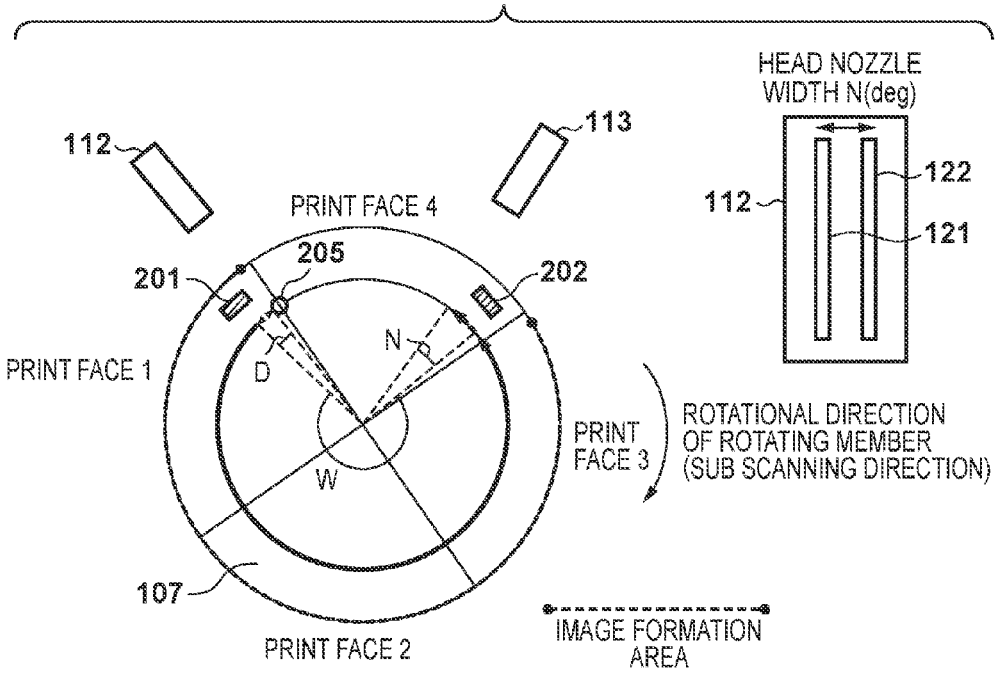
FIG. 18 is a figure for explaining a configuration condition according to the present invention.

FIG. 18 is a view for illustrating a positional relationship between the rotating member 107, the connecting portion 205, and the encoder sensors 201 and 202, at a timing for the most upstream head (the printhead 112) to start image formation on the print face 1. In addition, FIG. 18 illustrates a configuration condition in a case where the encoder sensor 201 is used. A head nozzle width N (deg) indicates, by an angle conversion of the rotating member 107, a width from a most upstream nozzle array 121 of the most upstream head (the printhead 112) to a most downstream nozzle array 122. An image formation area width W indicates, by an angle conversion of the rotating member 107, a width of an image formation area on which printing is actually caused to be performed. FIG. 18 illustrates a case in which the print face 1, the print face 2, and the print face 3 are printed on. A scale area S indicates, by an angle conversion of the rotating member 107, a width of an area, which can be read by the encoder sensors 201 and 202, resulting from subtracting an indefinite portion due to the connecting portion 205 from the entire circumference (360°) of the rotating member 107. D indicates, by an angle conversion of the rotating member 107, a length from the start of the linear encoder scale 200 (an edge of the connecting portion 205) until the start of image forming by the most upstream head (the printhead 112). W+N indicates a scale length necessary for image formation by the most downstream nozzle array (the printhead 113) to complete after the most upstream nozzle array (the printhead 112) has started image formation. In the present embodiment, the connecting portion 205 must not be included in this area.

In a case where there is a desire to print without changing for the same print face, the configuration condition of $$W+N<S-D \tag{2}$$

needs to be satisfied. As described above, this configuration condition excludes the condition of using the same encoder sensor by printheads of all colors. The configuration of FIG. 18 satisfies configuration condition (2). In other words, in the case of the configuration of FIG. 18, that it is possible to use the encoder sensor 201 to perform printing without changing printing of the print faces 1, 2, and 3 is illustrated.

Figure 19:
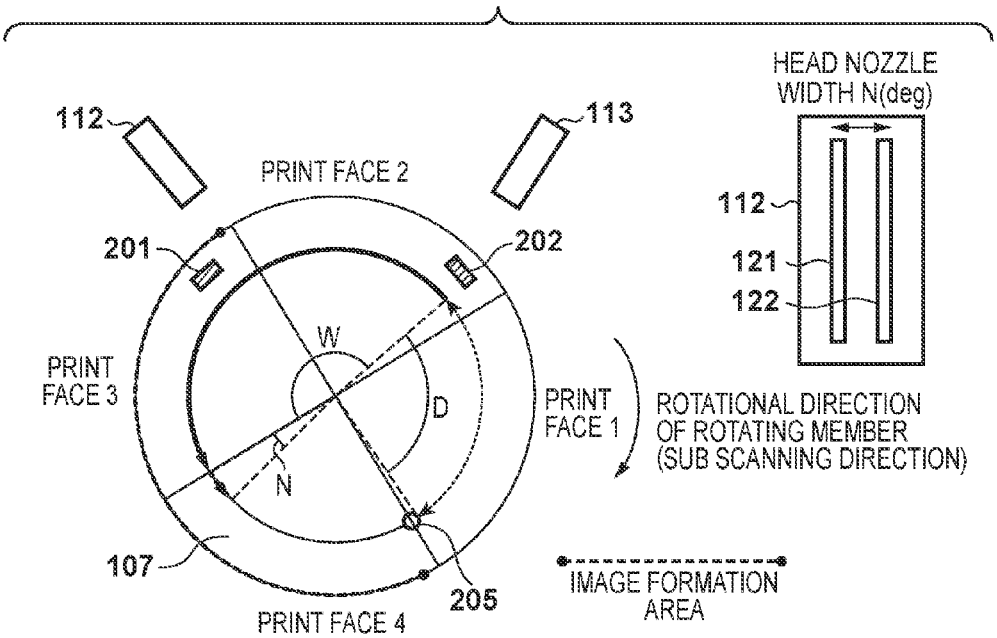
FIG. 19 is a figure for explaining a configuration condition according to the present invention.

FIG. 19 is a view for illustrating a positional relationship between the rotating member 107, the connecting portion 205, and the encoder sensors 201 and 202, at a timing for the most upstream head (the printhead 112) to start image formation on the print face 3. In addition, FIG. 19 illustrates a configuration condition in a case of using the encoder sensor 202. FIG. 19 indicates a case of printing to the print face 3 and the print face 4, where configuration condition (2) is satisfied. In other words, the case of the configuration of FIG. 19 is a configuration in which it is possible to use the encoder sensor 202 to perform printing without changing printing of the print faces 3 and 4.

Figure 20:
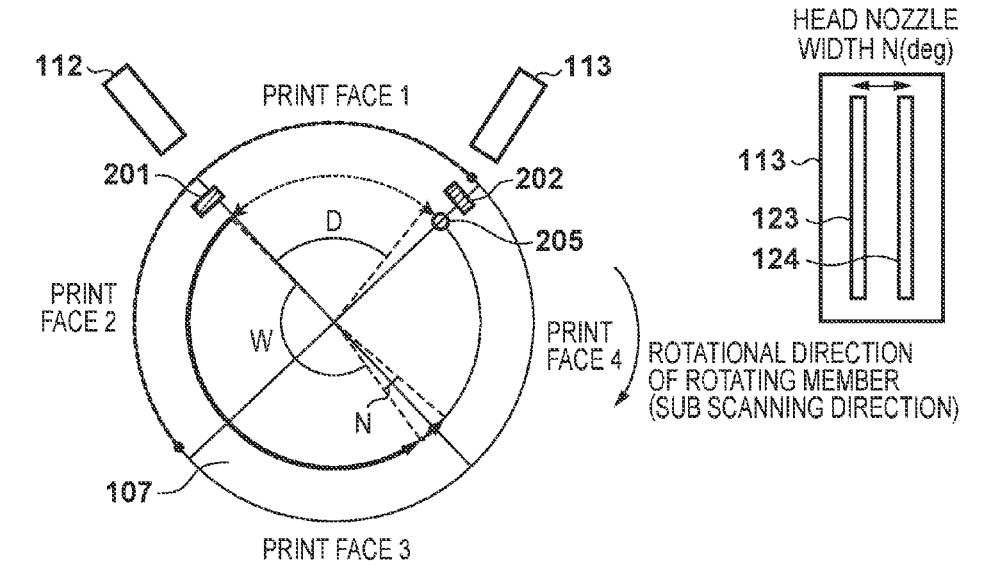
FIG. 20 is a figure for explaining a configuration condition according to the present invention.

FIG. 20 is a view for illustrating a positional relationship between the rotating member 107, the connecting portion 205, and the encoder sensors 201 and 202, at a timing for the most downstream head (the printhead 113) to start image formation on the print face 1. In addition, FIG. 20 illustrates a configuration condition in a case where the encoder sensor 201 is used. A head nozzle width N (deg) indicates, by an angle conversion of the rotating member 107, a width from a most upstream nozzle array 123 of the most downstream head (the printhead 113) to a most downstream nozzle array 124. FIG. 20 indicates a case of printing to the print face 1 and the print face 2, where configuration condition (2) is satisfied. In other words, the case of the configuration of FIG. 20 is a configuration in which it is possible to use the encoder sensor 202 to perform printing without changing printing of the print faces 1 and 2.

Figure 21:
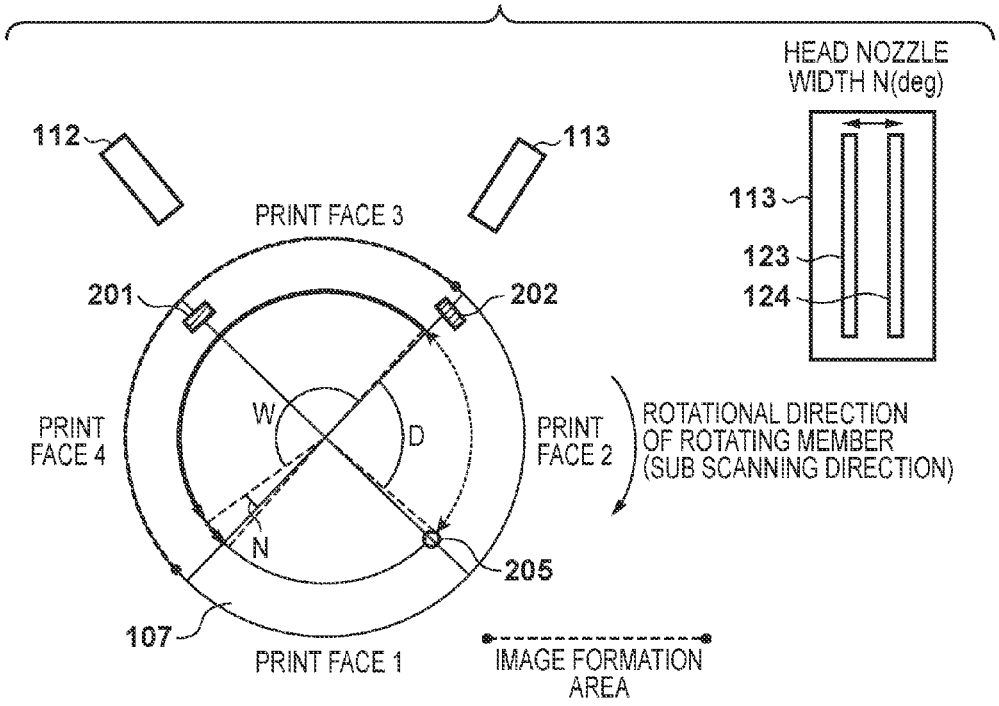
FIG. 21 is a figure for explaining a configuration condition according to the present invention.

FIG. 21 is a view for illustrating a positional relationship between the rotating member 107, the connecting portion 205, and the encoder sensors 201 and 202, at a timing for the most downstream head (the printhead 113) to start image formation on the print face 3. In addition, FIG. 21 illustrates a configuration condition in a case of using the encoder sensor 202. FIG. 21 indicates a case of printing to the print face 3 and the print face 4, where configuration condition (2) is satisfied. In other words, the case of the configuration of FIG. 21 is a configuration in which it is possible to use the encoder sensor 202 to perform printing without changing printing of the print faces 3 and 4.

In FIG. 18 through FIG. 21, the positions of the printheads, the connecting portion, and the encoder sensors are in the same configuration, and a print face that can be printed therein is explained. By the above, change control for discharge timing as explained by FIG. 22 below is possible.

Figure 22:
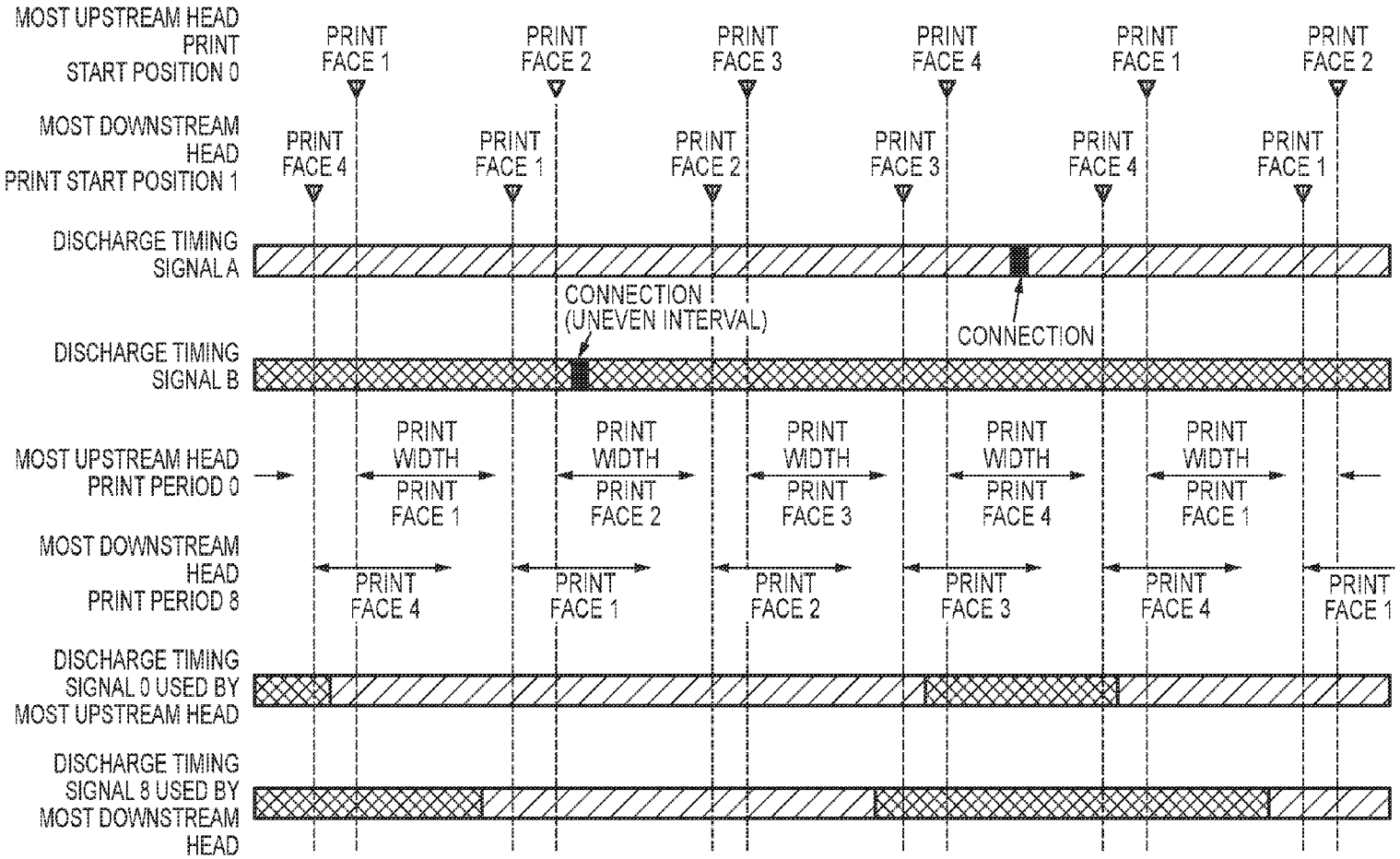
FIG. 22 is a figure illustrating a timing chart for discharge timing generation.

FIG. 22 is a timing chart for a case of the configuration explained by FIG. 18 through FIG. 21. Explanation is given for timing at which the discharge timing selection unit 506 of FIG. 5 selects discharge timing signals generated based on the signals from each encoder sensor by the discharge timing generation unit 505 of FIG. 5 so that there is no effect on printing, and outputs to the print control unit 405 of a latter-stage.

FIG. 22 illustrates relationships for various timings, and illustrates in order from the top:

a print start position 0 (start timing) for the most upstream head (the printhead 112);

a print start position 8 for the most downstream head (the printhead 113);

a discharge timing signal A generated by the encoder sensor 201;

a discharge timing signal B generated by the encoder sensor 202;

a most upstream head printing period 0 indicating a period in which the most upstream head performs printing;

a most downstream head printing period 8 indicating a period in which the most downstream head performs printing;

a discharge timing signal 0 used by the most upstream head; and a discharge timing signal 8 used by the most downstream head.

A state is illustrated in which, with the discharge timing signal 0 that the most upstream head uses, the discharge timing signal A is selected before the position of the print face 1, and the discharge timing signal B is selected before the print face 4. In addition, with the discharge timing signal 8 that the most downstream head uses, the discharge timing signal A is selected before the position of the print face 1, and the discharge timing signal B is selected before the print face 3. In other words, in the print face 3, encoder sensors used by the most upstream head and the most downstream head differ.

By relaxing the conditions in this way, it is possible to more easily configure a printing apparatus than under the conditions of configuration condition (1), as with configuration condition (2).

Note that, although description was given in the embodiments regarding a form in which an image is printed to a printing medium by discharging printing material on a printing area on a rotating member to printing the image on the printing area, and then transferring the image to the printing medium, but an embodiment in accordance with another form is possible. For example, it may be a form in which a printing medium is bonded to the printing area on the rotating member, and printing is performed by directly discharging printing material onto the printing medium on the rotating member from printheads.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-107790, filed May 30, 2016, which is hereby incorporated by reference herein in its entirety.

What is claimed is:

1. A printing apparatus, comprising:

a rotating member having a plurality of printing areas on a circumference thereof;

a printhead configured to discharge printing material onto the plurality of printing areas;

a linear encoder scale having slits and provided on the circumference of the rotating member along a rotation direction;

a plurality of encoder sensors provided at different positions in the rotation direction of the linear encoder scale, and configured to detect the slits of the linear encoder scale; and an adjustment unit configured to adjust a timing of discharge from the printhead by using a detection result by at least one of the encoder sensors, wherein the adjustment unit adjusts a timing of discharge from the printhead with respect to a first printing area out of the plurality of printing areas based on a detection result of a first encoder sensor, and adjusts a timing of discharge from the printhead with respect to a second printing area based on the detection result of a second encoder sensor, without using the detection result of the first encoder sensor, and the first encoder sensor is provided at a position corresponding to an area of the circumference in which the slits are provided during the discharge of the printing material from the printhead to the first printing area and corresponding to an indefinite area of the circumference in which no slit is provided within a discharge of the printing material from the printhead to the second printing area, and the second encoder sensor is provided at a position corresponding to an area of the circumference in which the slits are provided during the discharge of the printing material from the printhead to the second printing area.

2. The printing apparatus according to claim 1, further comprising a plurality of printheads.

3. The printing apparatus according to claim 2, wherein, when some printheads out of the plurality of printheads discharge the printing material with respect to the first printing area simultaneously to remaining printheads discharging with respect to the second printing area, the adjustment unit (i) adjusts the timing of discharge from the some printheads, without using the detection result of the second encoder sensor, based on the detection result of the first encoder sensor, and (ii) adjusts the timing of discharge from the remaining printheads, without using the detection result of the first encoder sensor, based on the detection result of the second encoder sensor.

4. The printing apparatus according to claim 2, wherein a positional relationship between the plurality of printheads, the plurality of encoder sensors, and the indefinite area of the linear encoder scale is arranged such that, when a head width from (i) a position of a most upstream nozzle array in the rotation direction of a plurality of nozzle arrays and which is in a most upstream head that is positioned most upstream in the rotation direction to (ii) a position of a most downstream nozzle array in the rotation direction of a plurality of nozzle arrays and which is in a most downstream head that is positioned most downstream in the rotation direction is H, a length, in the rotation direction, from a nominal position of the linear encoder scale to a position at which the most upstream nozzle array starts printing is D, a width of the printing area in the rotation direction is W, and a length resulting from subtracting the width of the indefinite area from the circumference of the rotating member in the rotation direction is S, $$W+H<S-D$$

holds true.

5. The printing apparatus according to claim 4, wherein the nominal position is a position of the indefinite area of the linear encoder scale.

6. The printing apparatus according to claim 2, wherein a positional relationship between the plurality of printheads, the plurality of encoder sensors, and the indefinite area of the linear encoder scale is arranged such that, when a head nozzle width to a position of a most downstream nozzle array from a position of a most upstream nozzle array in the rotation direction of a plurality of nozzle arrays in a most upstream head that is positioned most upstream in the rotation direction is N, a length, in the rotation direction, from a nominal position of the linear encoder scale to a position at which the most upstream nozzle array starts printing is D, a width of the printing area in the rotation direction is W, and a length resulting from subtracting the width of the indefinite area from the circumference of the rotating member in the rotation direction is S, $$W+N<S-D$$

holds true.

7. The printing apparatus according to claim 6, wherein the nominal position is a position of the indefinite area of the linear encoder scale.

8. The printing apparatus according to claim 2, wherein distances between the plurality of encoder sensors in the rotation direction are longer than a distance between two printheads, out of the plurality of printheads, that are arranged at the most separated positions in the rotation direction.

9. The printing apparatus according to claim 1, wherein the indefinite area is a space in the linear encoder scale.

10. The printing apparatus according to claim 1, wherein an image is printed on a printing medium by discharging the printing material onto a printing area on the rotating member from the printhead and then transferring the image from the printing area to the printing medium.

11. A printing apparatus, comprising:

a rotating member having a plurality of printing areas on a circumference thereof;

a printhead configured to discharge printing material onto the plurality of printing areas;

a linear encoder scale having slits and provided on the rotating member along a rotation direction;

a plurality of encoder sensors provided at different positions in the rotation direction of the linear encoder scale, and configured to detect the slits of the linear encoder scale; and an adjustment unit configured to adjust a timing of discharge from the printhead by using a detection result by at least one of the encoder sensors, wherein the adjustment unit adjusts a timing of discharge from the printhead with respect to a first printing area out of the plurality of printing areas based on a detection result of a first encoder sensor, and adjusts a timing of discharge from the printhead with respect to a second printing area based on a detection result of a second encoder sensor, without using the detection result of the first encoder sensor, and the first encoder sensor is provided at a position corresponding to an area in which the slits are provided during the discharge of the printing material from the printhead to the first printing area and corresponding to a space between both ends of the encoder scale within a discharge of printing material from the printhead to the second printing area, and the second encoder sensor is provided at a position corresponding to an area of the circumference in which the slits are provided during the discharge of the printing material from the printhead to the second printing area.

12. The printing apparatus according to claim 11, wherein the linear encoder scale is provided on a circumference of the rotating member.

13. A printing method in a printing apparatus, the printing apparatus having a rotating member having a plurality of printing areas on a circumference thereof, a printhead configured to discharge printing material on the plurality of printing areas, a linear encoder scale having slits and provided on the circumference of the rotating member along a rotation direction, and a plurality of encoder sensors provided at different positions in the rotation direction of the linear encoder scale, and configured to detect the slits of the linear encoder scale, the printing method comprising:

adjusting a timing of discharge from the printhead by using a detection result by at least one of the encoder sensors, wherein, a timing of discharge from the printhead with respect to a first printing area out of the plurality of printing areas is adjusted based on a detection result of a first encoder sensor, and a timing of discharge from the printhead with respect to a second printing area is adjusted based on the detection result of a second encoder sensor, without using the detection result of the first encoder sensor, and the first encoder sensor is provided at a position corresponding to an area of the circumference in which the slits are provided during the discharge of the printing material from the printhead to the first printing area, and corresponding to an indefinite area of the circumference in which no slit is provided within a discharge of the printing material from the printhead to the second printing area, and the second encoder sensor is provided at a position corresponding to an area of the circumference in which the slits are provided during the discharge of the printing material from the printhead to the second printing area.

14. The printing method according to claim 13, wherein the printing apparatus has a plurality of printheads.

15. The printing method according to claim 14, wherein, when some printheads out of the plurality of printheads discharge the printing material with respect to the first printing area simultaneously to remaining printheads discharging the printing material with respect to the second printing area, the timing of discharge from the some printheads is adjusted, without use of the detection result of the second encoder sensor, based on the detection result of the first encoder sensor and the timing of discharge from the remaining printheads is adjusted, without use of the detection result of the first encoder sensor, based on the detection result of the second encoder sensor.

16. The printing method according to claim 14, wherein a positional relationship between the plurality of printheads, the plurality of encoder sensors, and the indefinite area of the linear encoder scale is arranged such that, when a head width from (i) a position of a most upstream nozzle array in the rotation direction of a plurality of nozzle arrays and which is in a most upstream head that is positioned most upstream in the rotation direction to (ii) a position of a most downstream nozzle array in the rotation direction of a plurality of nozzle arrays and which is in a most downstream head that is positioned most downstream in the rotation direction is H, a length, in the rotation direction, from a nominal position of the linear encoder scale to a position at which the most upstream nozzle array starts printing is D, a width of the printing area in the rotation direction is W, and a length resulting from subtracting the width of the indefinite area from the circumference of the rotating member in the rotation direction is S, $$W+H<S-D$$

holds true.

17. The printing method according to claim 16, wherein the nominal position is a position of the indefinite area of the linear encoder scale.

18. The printing method according to claim 14, wherein a positional relationship between the plurality of printheads, the plurality of encoder sensors, and the indefinite area of the linear encoder scale is arranged such that, when a head nozzle width to a position of a most downstream nozzle array from a position of a most upstream nozzle array in the rotation direction of a plurality of nozzle arrays in a most upstream head that is positioned most upstream in the rotation direction is N, a length, in the rotation direction, from a nominal position of the linear encoder scale to a position at which the most upstream nozzle array starts printing is D, a width of the printing area in the rotation direction is W, and a length resulting from subtracting the width of the indefinite area from the circumference of the rotating member in the rotation direction is S, $$W+N<S-D$$

holds true.

* * * * *